United States Patent [19]

Gardner

[11] 4,002,836

[45] Jan. 11, 1977

[54] AUDIO SIGNAL DISTRIBUTOR

[76] Inventor: Gilbert MacLean Gardner, 58 Brighton Ave., San Francisco, Calif. 94112

[22] Filed: July 24, 1975

[21] Appl. No.: 598,836

[52] U.S. Cl. ..... 179/1 GQ; 179/1 VL; 179/1 B; 338/143

[51] Int. Cl.[2] ..... H04R 5/00

[58] Field of Search ..... 179/1 GQ, 1 G, 1 GP, 179/1 VL, 1 B; 338/139, 140, 143, 190

[56] References Cited

UNITED STATES PATENTS

| | | | |
|---|---|---|---|
| 2,832,829 | 4/1958 | Reynolds | 179/1 GP |
| 3,082,295 | 3/1963 | Marsov | 179/1 G |
| 3,165,714 | 1/1965 | Dreyfus | 338/190 |
| 3,665,105 | 5/1972 | Chowning | 179/1 G |
| 3,676,594 | 7/1972 | Shore | 179/1 VL |
| 3,757,046 | 9/1973 | Williams | 179/1 G |
| 3,848,092 | 11/1974 | Shamma | 179/1 GP |

*Primary Examiner*—Douglas W. Olms

[57] ABSTRACT

The Audio Signal Distributor (abbreviated ASD) is a device which takes the current from the amplifier output and distributes it in varying ratios to a plurality of speakers.

The nature of the invention is a modified rheostat which divides the output current into separate currents of varying ratio. When a plurality of speakers are excited by these currents the illusion of sound movement from speaker to speaker is created maintaining a constant loudness level.

6 Claims, 10 Drawing Figures

AUDIO SIGNAL DISTRIBUTOR

POSSIBLE APPLICATIONS

In performance whereby a plurality of speakers are arranged around the audience in a circular fashion, by distributing the signal current in varying ratios consecutively from one speaker to it's adjacent speaker the sound may be made to appear as if it had moved in a circle around the audience. As this cycle of distribution in a circular fashion is increased in time (increased RPM) the illusion of movement from speaker to speaker becomes less apparent while a second illusion "sound division" becomes noticeable. As each tone is sounding progressively, the distributor is changing the speaker which is to receive the signal. The result is that a series of tones are spatially divided amongst all of the speakers.

In a quadraphonic arrangement of speakers a common stereo or monaural signal may be divided up amongst the four speakers in a new and quadraphonically interesting way. Home entertainment monaural or stereo music systems may be converted to quadraphonic interest by running the amplifier signal output through the ASD into four speakers. With the stereo system even greater diversity may be achieved by running left and right channels separately through two ASDs.

One advantage of the ASD use is that it adapts easily to any existing amplifying system by connecting directly to the amplifier output where the speakers normally connect, the only modification being the addition of extra speakers (total four). Another advantage of the ASD use is that any existing monaural or stereo recordings may be given quadraphonic interest by spatially dividing the music through the ASD.

DESCRIPTION OF THE INVENTION

Figure 1:
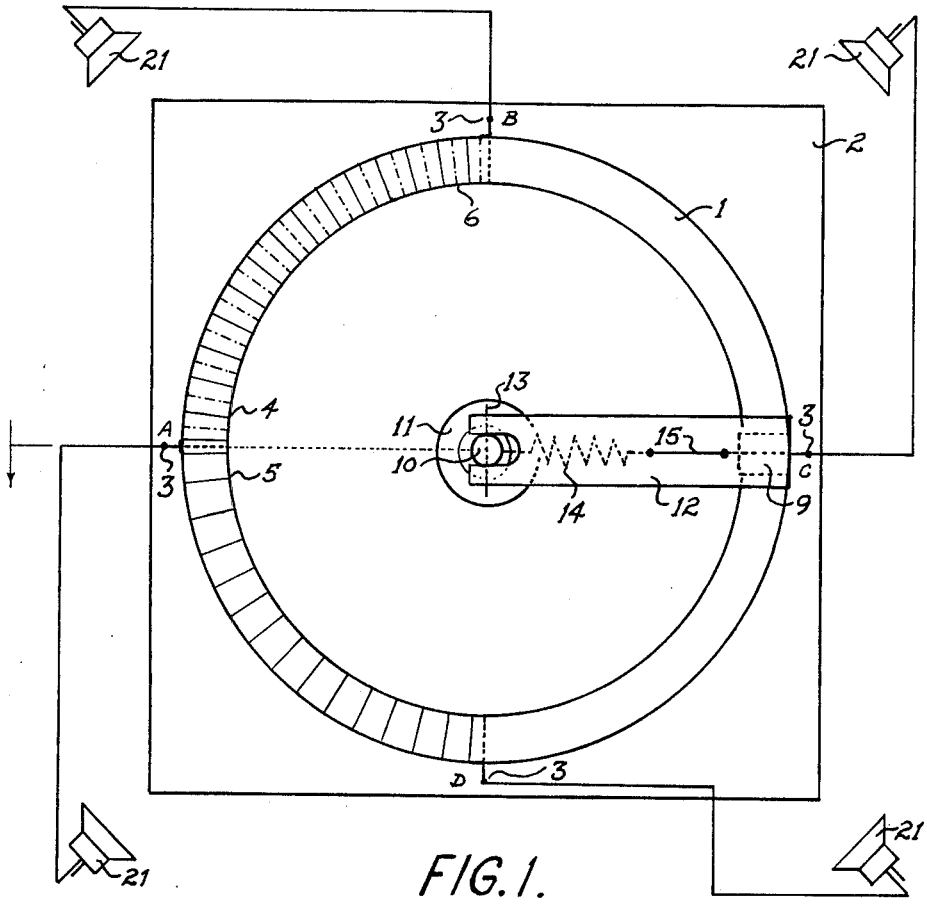
FIG. 1 is a top view of the ASD showing the complete windings of the tie point 'A' and the interlaced windings of tie points 'A' and 'B'.

Referring to FIG. 1, the ASD shown is one having four outputs. It is basically a cylindrical section dielectric form (1) mounted on a mounting block (2), with conductive tie points (3) attached to the form equidistant apart at each desired output. Each tie point is connected to two windings wound around the form. The drawing shows the complete windings of tie point A only (4 and 5) and one quadrant of interlaced windings (4 and 6).

Figure 7:
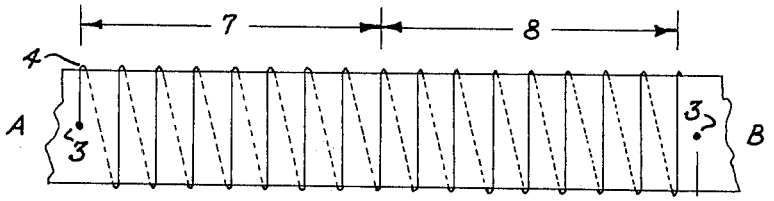
FIG. 7 is a single quadrant of the ASD — point A to point B of FIG. 1 — showing the resistive and nonresistive winding of tie point A only.
Figure 8:
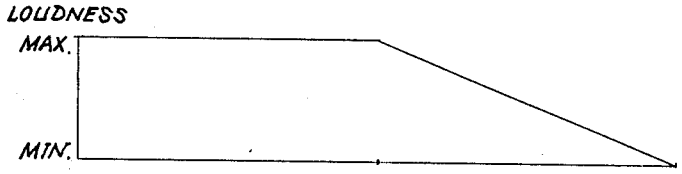
FIG. 8 is a graph of the change in loudness experienced at speaker A as a result of the change in resistence between slider and tie point A as the slider moves across the windings from point A to point 'B'.
Figure 9:
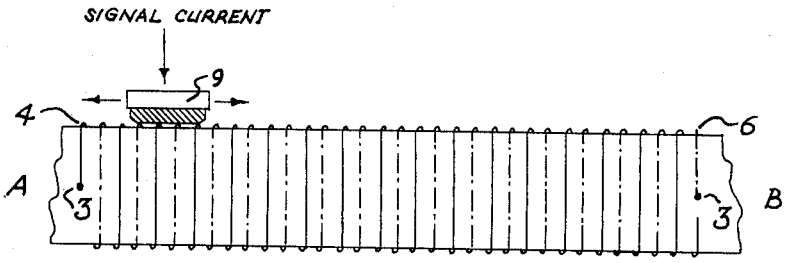
FIG. 9 is a single quadrant of the ASD — point A to point B of FIG. 1 — showing the windings of A and B tie points interlaced and electrically isolated from one another except where the slider makes contact. The figure also shows the division of the audio signal current at the slider connection.

Using the windings of tie point A as an example refer to FIG. 1. At tie point A one winding (4) extends from the tie point up to tie point B and a second winding (5) extends in the opposite direction up to tie point D. Each quadrant of the form is shared by the interlaced windings-examples (4) and (6)-of the two tie points located at the quadrant borders as shown in FIGS. 1 & 9. Referring particularly to the one winding (4) of tie point A in FIG. 7, a non-resistive wire (7) is attached to tie point A and wound around the form in equally spaced loops up to the midpoint between tie points A and B. At the midpoint the non-resistive wire is spliced to a wire (8) having a resistive quality. The now resistive wire is wound around the form up to—although not touching—tie point B where it is terminated. Referring to FIG. 9, the windings of tie point B (6) are of the same construction as the winding (4) described in FIG. 7, attached to tie point B and terminated near tie point A. The drawing shows the two windings (4) and (6) interlaced and electrically isolated from one another—disregarding the contact made with the slider (9).

Figure 2:
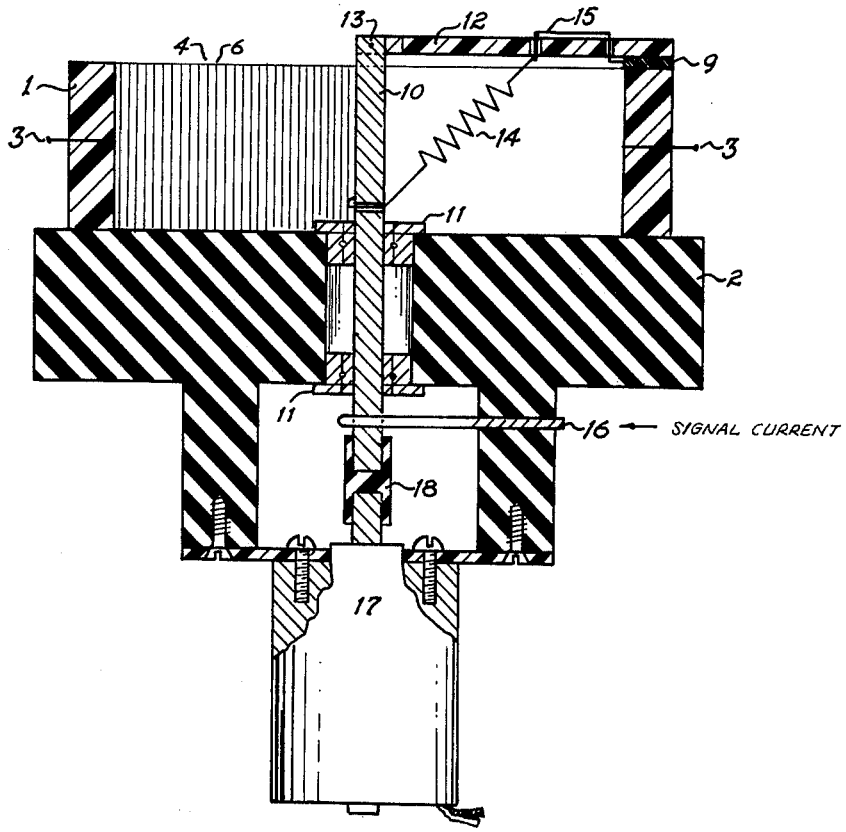
FIG. 2 is a side view cross section of the ASD showing motor mount, commutator contact bar, and the bearing assembly.

Referring to FIGS. 1 & 2, an elongated conductive shaft (10) is mounted through two bearings (11) in the mounting block (2) for free rotation about the form's (1) central vertical axis. An armature (12) is attached to the shaft by means of a connecting pin (13) such that it may vertically pivot on the shaft. The armature extends perpendicularly from the shaft out the radius of the ASD form. Mounted on the underside of the armature directly over the windings is an electrical contact slider (9) having a width sufficient to make contact with the interlaced windings of two tie points at all times. A conductive spring (14) is connected between the shaft and armature thereby placing a pressure upon the slider to insure good electrical contact with the windings. The spring is electrically connected by wire (15) to the slider creating a conductive path between the shaft and slider. A commutator contact bar (16) is attached to the mounting block (2) making contact with the shaft (10). The contact bar will be the place of input for signal current from the amplifier output, thus enabling a continuous conductive path for signal current from the amplifier output to the slider (9) at all times while the shaft is rotating. The shaft is connected to a variable speed motor (17), mounted on the block, by means of a flexible non-conductive joint (18) effectively isolating the motor from the shaft.

A second embodiment of the ASD is illustrated in FIGS. 3–6. The essential difference being in the construction of the pairs of conductive paths attached to the tie points.

Figure 3:
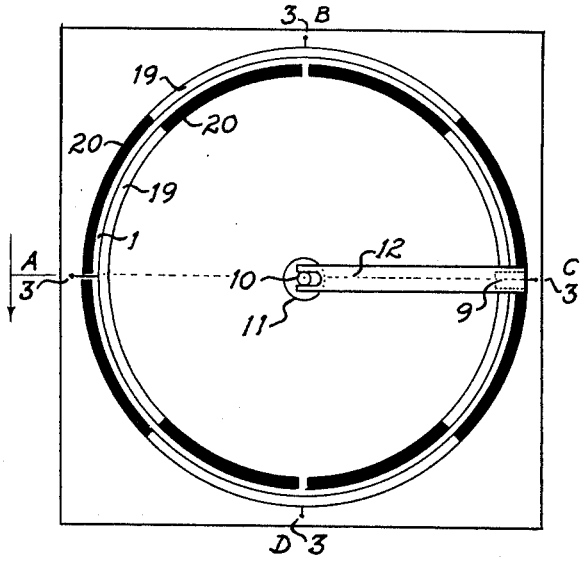
FIG. 3 is a top view of another embodiment of the ASD showing tie point conductive strips.

Referring to FIG. 3, the paths here are conductive strips rather than conductive windings described previously. Using the conductive paths of tie point A as an example; at tie point A one strip—the combined sections (19) and (20)—extends from the tie point along the inner edge of the dielectric form (1) up to tie point B and a second strip extends along the inner edge up to tie point D. Each strip is comprised of a non-resistive section (19) spliced at midpoint—between tie points A and B, and A and D—to a resistive section (20). The strips of adjacent tie points B and D are constructed in the same manner as those of tie point A although they are positioned along the form's (1) outer edge. The resistive sections of all tie points on the ASD form are equal in resistive value. Each quadrant of the ASD form is shared by the concentric conductive strips of the two tie points located at the quadrant borders. The pairs of conductive strips of all tie points are electrically independent of one another.

Figure 4:
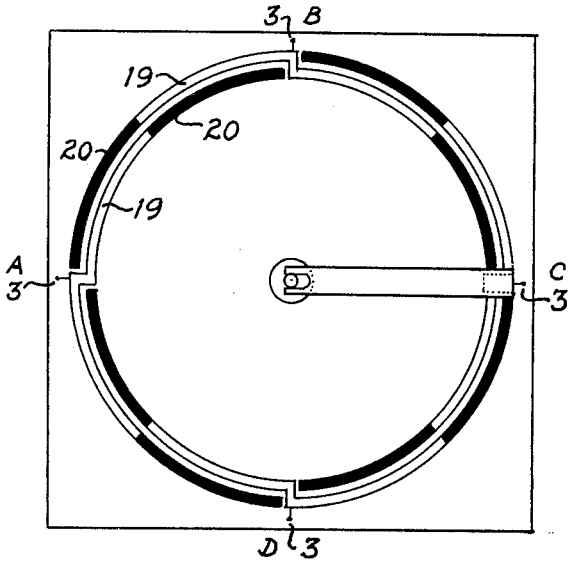
FIG. 4 is a top view of the same embodiment of FIG. 3 having a slightly different conductive strip layout.

FIG. 4 is basically the same embodiment of the ASD as described in FIG. 3, having a slightly different strip arrangement. Here each tie point has one strip mounted along the outer edge of the form and one strip mounted along the inner edge.

Figure 5:
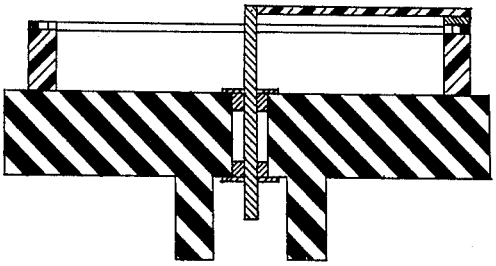
FIG. 5 is a simplified side view crosssection of FIGS. 3 & 4. The assemblage is basically the same as FIG. 2.

The assemblage of FIG. 5 is essentially identical to that which was described in FIG. 2.

Figure 6:
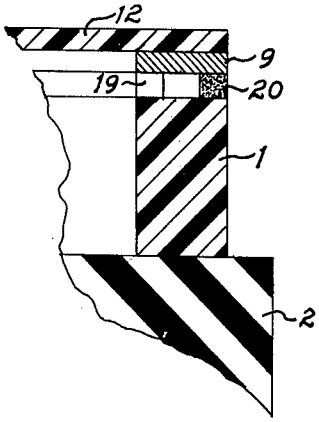
FIG. 6 is a detail of the slider-strip connection shown in FIG. 5.

FIG. 6 is a detail of the slider (9) having a width sufficient to make simultaneous contact with the conductive strips (19) and (20) mounted along the inner and outer edges of the ASD form (1).

OPERATION

Four speakers (21) are positioned in a square around the listener in a quadraphonic arrangement. The speakers are wired at common ground with the amplifier. The signal lead from the amplifier is attached to the ASD at the commutator input. The signal is separated by the ASD and sent to the four speakers, each being connected to one of the tie point outputs on the ASD.

Figure 10:
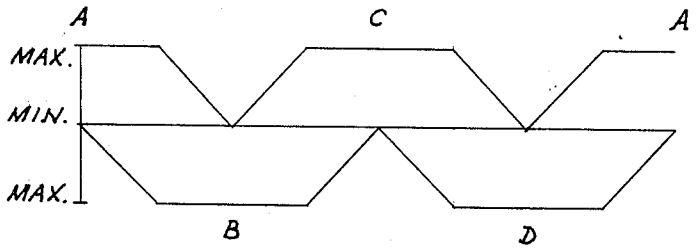
FIG. 10 is a graph of the loudness cycle for each speaker as the slider moves 360°— point A around to point A — across the ASD windings.

The motor is adjusted to a desired speed thus rotating the armature, the slider (9) moves across the windings. Refer to FIG. 9 the drawing shows the division of signal current at the slider into two separated currents, one going to speaker A by way of tie point A and another to speaker B by way of tie point B. Referring to FIG. 10, as the slider moves from tie point A to the midpoint between A and B the resistance between amplifier output and speaker A is minimum—therefore full loudness is experienced at speaker A. At the same time the resistance between amplifier output and speaker B at tie point A is maximum—therefore the sound at speaker B is inaudible, as the slider approaches midpoint the resistance between amplifier output and speaker B is decreasing causing the loudness experienced to increase. At midpoint the signal current from the amplifier sees minimal resistance to both tie points, consequently both speakers are excited to full loudness. As the slider moves from the midpoint to tie point B the resistance to speaker A increases—loudness decreases—while resistance to speaker B remains minimal, therefore continued maximum loudness. The result of this changing ratio of loudness creates the illusion of sound movement from speaker A to speaker B. If the armature is rotated a full 360° the four speakers will complete the loudness cycle shown in FIG. 10 and the sound will appear as if to move in a circle around the listener while a constant loudness has been maintained. As the cycle is increased in time—increased RPM of motor—the phenomenon of "sound division" described in Possible Applications is realized.

What I claim is:

1. An audio sound producing system comprising:
   a. a plurality of speakers arranged in a preselected pattern about a listening area;
   b. a source of audio signals capable of actuating said speakers;
   c. an audio signal distributing device for distributing said source of audio signals through said speakers, said audio signal distributing device including an annular dielectric form;
   d. a plurality of tie-points, mounted an equal distance apart, on said form, the number of said tie-points corresponding to the number of said speakers;
   e. a shaft adapted to be rotated at the center of said dielectric form, said shaft having a wiper arm thereon, said wiper arm passing over said form;
   f. a pair of conductive windings for each tiepoint, each winding of the pair being wound in opposite directions around the form up to the next adjacent tie-point, but being insulated from the adjacent tie-point.

2. The audio signal distributing device of claim 1 wherein each winding of said pair comprises a first non-resistive section attached to said tie-point and a second resistive section forming an electrical continuation of the non-resistive section.

3. The structure of claim 1 wherein the audio signal distributing device contains four tie-points.

4. An audio sound producing system comprising:
   a. a plurality of speakers arranged in a preselected pattern about a listening area;
   b. a source of audio signals capable of actuating said speakers;
   c. an audio signal distributing device for distributing said source of audio signals through said speakers, said audio signal distributing device including an annular dielectric form;
   d. a plurality of tie-points, mounted an equal distance apart, on said form, the number of said tie-points corresponding to the number of said speakers;
   e. a shaft adapted to be rotated at the center of said dielectric form, said shaft having a wiper arm thereon, said wiper arm passing over said form;
   f. a pair of conducting strips on said form forming a continuation of each tie-point, the strips extending in opposite directions from the tie-point up to the next adjacent tie-point but insulated from said adjacent tie-point, each strip being comprised of a first non-resistive section adjacent to the tie-point, and a second resistive section formed as an electrical continuation of the non-resistive section.

5. The audio signal distributing device of claim 4 wherein each said conductive strip is mounted along one of two concentric circles, said circles being concentric about the form's center up to the axis formed by the adjacent tie-point.

6. The audio signal distributing device of claim 5 wherein the two strips of said conductive pair extend in opposite directions from said tie-point along the concentric circle not occupied by adjacent tie-point strips, and being electrically isolated from adjacent tie-points.

* * * * *